US005181321A

United States Patent [19]

Gouttebarge

[11] Patent Number: 5,181,321

[45] Date of Patent: Jan. 26, 1993

[54] PROCESS FOR MANUFACTURING CUTTING BLADES

[75] Inventor: Jean C. Gouttebarge, Cusset, France

[73] Assignee: Etablissements Gouttebarge, Chabreloche, France

[21] Appl. No.: 696,581

[22] Filed: May 7, 1991

[30] Foreign Application Priority Data

Feb. 28, 1991 [FR] France ..... 91 02769

[51] Int. Cl.[5] ..... B26B 9/02

[52] U.S. Cl. ..... 30/357; 30/346; 76/104.1

[58] Field of Search ..... 51/285; 30/346, 357; 76/104.1; 72/340

[56] References Cited

U.S. PATENT DOCUMENTS 2,182,067 12/1939 Bruecker ..... 76/104.1 X
2,423,177 7/1947 Cunliffe ..... 76/104.1 X
3,741,046 6/1973 Chambon .

*Primary Examiner*—Douglas D. Watts
*Attorney, Agent, or Firm*—Oliff & Berridge

[57] ABSTRACT

Part of a cutting blade blank corresponding to a cutting edge is bent such that it is tilted at a grinding angle relative to the longitudinal median plane of the blank. After heat treatment, the cutting edge is sharpened by grinding only that part of the blank which extends from the median plane of the blank until the apex of the cutting edge is in the median plane.

10 Claims, 1 Drawing Sheet

PROCESS FOR MANUFACTURING CUTTING BLADES

TECHNICAL FIELD

The invention relates to a process for manufacturing cutting blades such as knife blades and the like.

BACKGROUND

To manufacture a cutting blade, for example, a knife blade, known techniques begin with a metal shape with a triangular section or a metal shape with a rectangular section, then, after cutting the blade and heat treatment, sharpening the cutting edge by grinding the two lateral faces of the blank.

This procedure requires two grinding operations and, despite the care exercised in positioning the blade, often results in blades in which the faces of the cutting edge are not at the same angle relative to the median plane of the blade, resulting in a knife which slips when cutting and is inconvenient to use.

SUMMARY OF THE INVENTION

An object of the present invention is to overcome the above disadvantages by providing a process for manufacturing cutting blades which reduces the number of operations and hence the manufacturing cost and which makes it possible to obtain a centered cutting edge which does not slip when cutting.

This process comprises an additional stage in the preparation of the cutting edge blank which comprises bending, preferably by stamping, the part of the blank corresponding to the cutting edge by tilting it at the grinding angle relative to the longitudinal median plane of the blank and, after any appropriate heat treatments, proceeding to sharpen the cutting edge by grinding only that part of the cutting edge blank which extends beyond the median plane of the blade until the apex of the cutting edge is in the median plane of the blade.

After polishing, the cutting edge is delimited between one face whose angle is determined by bending (e.g., stamping) and another face whose angle is determined by grinding. The bending is performed during the blank preparation phase, and does not lead to any extra expense, so that, by eliminating one grinding operation, the manufacturing cost of the blade is reduced. In one embodiment, the process comprises pushing the end of the bent part beyond the median plane of the blank while preparing the blank. This excess material ensures that the cutting edge will be centered.

BRIEF DESCRIPTION OF THE DRAWINGS

The invention will be better understood with the aid of the following description with reference to the attached schematic diagrams which show the application of this process to the manufacture of a knife blade.

DETAILED DESCRIPTION OF PREFERRED EMBODIMENTS

In the figures, 2 designates a blade integral with a tang 3 and provided with a cutting edge 4. This blade is made in known fashion by cutting a metal strip with a generally rectangular cross section.

Figure 2:
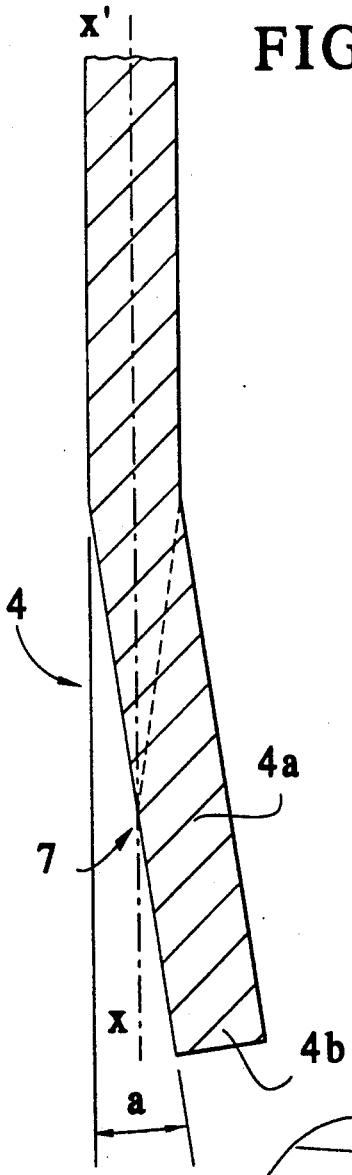
FIGS. 2 and 3 are partial views, sectioned along line II—II in FIG. 1, showing two stages in the manufacture of the cutting edge, namely its bending and then its sharpening.

According to the invention, during the cutting of the blade blank from the strip, as shown in FIG. 2, part 4*a* of this blank corresponding to the cutting edge is bent, preferably by stamping. The bending angle a is equal to the sharpening angle (which in a preferred embodiment has a value of 7.5°). The bending is preferably performed so that end 4*b* of part 4*a* is extended beyond the longitudinal median plane of the blank represented in FIG. 2 by axis x'—x.

Figure 3:
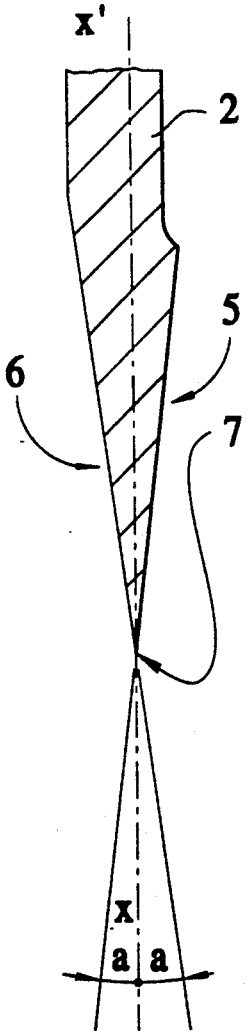

After any desired known heat treatments, final sharpening is performed by grinding the part extending from bent part 4*a*, in other words, by grinding face 5 shown in FIG. 3. This grinding, performed at a sharpening angle with a value a equal to the angle of inclination of face 6, is preferably performed until apex 7 of the cutting edge is in the longitudinal median plane represented by axis x'—x in FIG. 3.

By virtue of this arrangement, after the finishing operation, the cutting edge of the blade is delimited by one face 6 produced by the bending operation and one face 5 produced by a single sharpening operation, and these two faces may be perfectly centered angularly on either side of plane x'—x, which keeps the knife from slipping.

Figure 1:
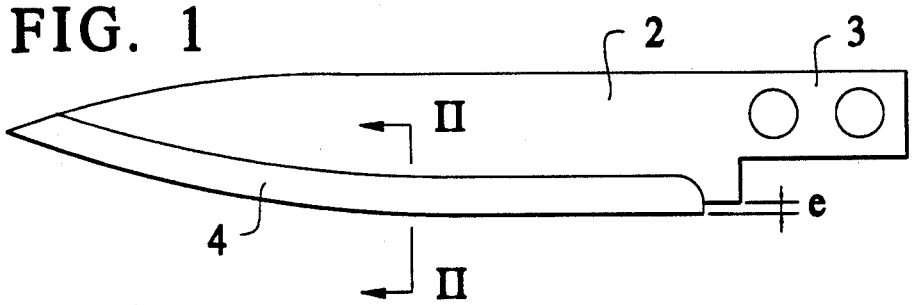
FIG. 1 is side view, showing in elevation one embodiment of a blade made according to the invention.
Figure 4:
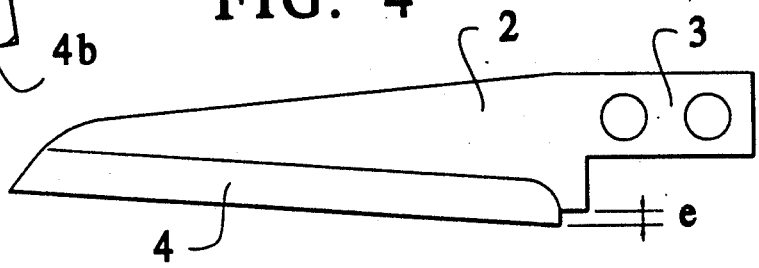
FIG. 4 is a side view showing an elevation of another embodiment of a blade made according to the invention.

FIG. 4 shows another blade shape comprising an application of this manufacturing process. In this blade, which may, like that in FIG. 1, be attached by ultrasonic welding to a handle made of synthetic material, cutting edge 4 extends down from the heel of the blade, by a value e, but it is clear that in other embodiments, for example, with a riveted handle, the cutting edge can extend for the entire length of the blade without departing from the scope of the invention.

What is claimed is:

1. A process for manufacturing a cutting blade, comprising the steps of:

bending a portion of a blade blank corresponding to a cutting edge of the cutting blade by tilting said portion at a sharpening angle relative to a longitudinal median plane of the blade blank;

grinding a part of the blade blank which extends beyond the median plane of the blade blank to form said cutting edge and;

heat treating said blade blank between said bending step and said grinding step.

2. A process for making a cutting blade from a blade blank comprising the steps of:

bending a portion of the blade blank corresponding to the cutting edge of the blade at a sharpening angle relative to a longitudinal median plane of the blade blank to dispose at least a part of said cutting edge portion beyond said median plane and thereby forming a first inclined face of a cutting edge of the blade;

grinding the part of said cutting edge portion extending beyond the median plane to form an inclined, ground second face disposed at an angle to said median plane substantially equal to the angle of said first face; and continuing said grinding step until a cutting edge formed by the intersection of the first face and the second face lies in said median plane.

3. The process according to claim 2, further comprising the step of heat treating said blade blank between said bending and said grinding step.

4. A process according to claim 2, wherein said bending is performed by stamping.

5. A process according to claim 2, wherein said bending step comprises bending said portion of said blade blank until an edge part of said portion extends completely past the median plane of the blade blank.

6. A process according to claim 3, wherein said bending is performed by stamping.

7. A process according to claim 3, wherein said bending step comprises bending said portion of said blade blank until an edge part of said portion extends completely past the median plane of the blade blank.

8. A cutting blade manufactured by the process comprising the steps of:

bending a portion of the blade blank corresponding to the cutting edge of the blade at a sharpening angle relative to a longitudinal median plane of the blade blank to dispose at least a part of said cutting edge portion beyond said median plane and thereby forming a first inclined face of a cutting edge of the blade;

grinding the part of said cutting edge portion extending beyond the median plane to form an inclined, ground second face disposed at an angle to said median plane substantially equal to the angle of said first face; and continuing said grinding step until a cutting edge formed by the intersection of the first face and the second face lies in said median plane, whereby the cutting edge is formed solely by the first bent surface and the second ground surface.

9. A cutting blade manufactured by the process according to claim 8, further comprising the step of heat treating said blade blank between said bending and said grinding step.

10. A cutting blade manufactured by a process comprising the steps of:

bending a portion of a blade blank corresponding to a cutting edge of the cutting blade by tilting said portion at a sharpening angle relative to a longitudinal median plane of the blade blank;

grinding a part of the blade blank which extends beyond the median plane of the blade blank to form said cutting edge and;

heat treating said blade blank between said bending step and said grinding step.

* * * * *